US010687626B2

(12) United States Patent
Yan

(10) Patent No.: US 10,687,626 B2
(45) Date of Patent: Jun. 23, 2020

(54) ELASTIC SEESAW-TYPE TILTING MECHANISM AND SWIVEL CHAIR HAVING THE SAME

(71) Applicant: Cheng Yu Yan, Shanghai (CN)

(72) Inventor: Cheng Yu Yan, Shanghai (CN)

( * ) Notice: Subject to any disclaimer, the term of this patent is extended or adjusted under 35 U.S.C. 154(b) by 0 days.

(21) Appl. No.: 16/291,468

(22) Filed: Mar. 4, 2019

(65) Prior Publication Data

US 2019/0328139 A1 Oct. 31, 2019

(30) Foreign Application Priority Data

Apr. 25, 2018 (CN) ..... 2018 1 0378091

(51) Int. Cl.
*A47C 1/032* (2006.01)
*A47C 3/30* (2006.01)
*A47C 7/14* (2006.01)

(52) U.S. Cl.
CPC ..... *A47C 1/03274* (2018.08); *A47C 1/03205* (2013.01); *A47C 1/03255* (2013.01); *A47C 3/30* (2013.01); *A47C 7/14* (2013.01)

(58) Field of Classification Search
CPC ..... A47C 1/03274; A47C 1/03272; A47C 1/03261; A47C 1/03205; A47C 1/03255; A47C 1/031; A47C 3/30; A47C 7/14; A47C 7/44; A47C 7/443
USPC ..... 297/292, 285, 293
See application file for complete search history.

(56) References Cited

U.S. PATENT DOCUMENTS 3,989,297 A * 11/1976 Kerstholt ..... A47C 1/022 297/300.3
4,494,795 A * 1/1985 Roossien ..... A47C 1/03222 108/9
5,425,566 A * 6/1995 Buchacz ..... A47C 1/03255 297/301.2
5,564,783 A * 10/1996 Elzenbeck ..... A47C 1/03255 297/300.2
6,003,943 A * 12/1999 Schneider ..... A47C 1/03255 29/428

(Continued)

FOREIGN PATENT DOCUMENTS

DE 7312840 * 9/1974

OTHER PUBLICATIONS

Translation of DE7312840 from Espacenet.com (Year: 2020).*

*Primary Examiner* — Mark R Wendell

(74) *Attorney, Agent, or Firm* — Muncy, Geissler, Olds & Lowe, P.C.

(57) ABSTRACT

An elastic seesaw-type tilting mechanism is provided, including: a base support, configured to be connected with a chair base through a chair column; a seat support, being pivotably mounted on the base support and configured to be connected with a seat; a backrest support, being pivotably mounted on the base support and configured to be connected with a backrest; a first elastic mechanism, being connected with the seat support and the backrest support to form an elastic seesaw mechanism; a second elastic mechanism, being connected with the base support and the seat support, the second elastic mechanism and the first elastic mechanism being respectively biased against the seat support in opposite directions. A swivel chair is further provided, including: one of the elastic seesaw-type tilting mechanism as described above, a seat, a backrest, a chair column and a chair base.

10 Claims, 11 Drawing Sheets

(56) References Cited

U.S. PATENT DOCUMENTS

| | | | | |
|---|---|---|---|---|
| 6,120,096 | A * | 9/2000 | Miotto | A47C 1/03255 297/300.1 |
| 6,523,896 | B1 * | 2/2003 | Uhlenbrock | A47C 1/032 297/300.3 |
| 9,549,614 | B2 * | 1/2017 | Bock | A47C 1/03211 |
| 2001/0026089 | A1 * | 10/2001 | Insalaco | A47C 1/03255 297/300.1 |
| 2005/0168030 | A1 * | 8/2005 | Bykov | A47C 3/0252 297/312 |
| 2006/0202530 | A1 * | 9/2006 | Lin | A47C 1/03238 297/300.1 |
| 2009/0066134 | A1 * | 3/2009 | Bock | A47C 1/024 297/301.3 |
| 2009/0261637 | A1 * | 10/2009 | Schmitz | A47C 1/03255 297/217.2 |
| 2011/0012409 | A1 * | 1/2011 | Bock | A47C 1/03255 297/285 |
| 2013/0221718 | A1 * | 8/2013 | Kelm | A47C 1/03272 297/337 |
| 2014/0300164 | A1 * | 10/2014 | Oda | A47C 1/03266 297/354.1 |
| 2014/0306503 | A1 * | 10/2014 | Ni | A47C 1/03272 297/285 |
| 2015/0123441 | A1 * | 5/2015 | Duke | A47C 1/03255 297/300.4 |
| 2015/0374132 | A1 * | 12/2015 | Bock | A47C 1/03255 297/303.4 |
| 2016/0192782 | A1 * | 7/2016 | He | A47C 1/03272 297/285 |
| 2019/0116979 | A1 * | 4/2019 | Kamiya | A47C 9/025 |

* cited by examiner

ELASTIC SEESAW-TYPE TILTING MECHANISM AND SWIVEL CHAIR HAVING THE SAME

BACKGROUND OF THE INVENTION

Field of the Invention

The present invention relates to an accessory to a swivel chair, especially to an elastic seesaw-type tilting mechanism and swivel chair having the same.

Description of the Prior Art

A conventional synchronized tilting swivel chair allows adjustment of a tilting angle of the swivel chair, but the tilting angle between a seat and a backrest is so limited within a specific range at a certain ratio, which is not comfortably suited to individuals. A limited tilting angle ratio between the seat and the backrest cannot provide preferable using experience. A swivel chair which allows tilting angles of the seat and backrest to be adjusted independently is available; however, the tilting pivot, elastic supporting still cannot satisfy required ergonomics and preferable comfortability.

The present invention is, therefore, arisen to obviate or at least mitigate the above-mentioned disadvantages.

SUMMARY OF THE INVENTION

The main object of the present invention is to provide an elastic seesaw-type tilting mechanism and swivel chair having the same, and the elastic seesaw-type tilting mechanism allows a seat and a backrest to be adjustable independently or simultaneously within a range.

To achieve the above and other objects, the present invention provides an elastic seesaw-type tilting mechanism, including: a base support, a seat support, a backrest support, a first elastic mechanism and a second elastic mechanism. The base support is configured to be connected with a chair base. The seat support is pivotably mounted on the base support and configured to be connected with a seat. The backrest support is pivotably mounted on the base support and configured to be connected with a backrest. The first elastic mechanism is connected with the seat support and the backrest support to form an elastic seesaw mechanism. The second elastic mechanism is connected with the base support and the seat support, and the second elastic mechanism and the first elastic mechanism are respectively biased against the seat support in opposite directions.

To achieve the above and other objects, the present invention further provides a swivel chair including one of the elastic seesaw-type tilting mechanism described above, further including a seat, a backrest, a chair column and a chair base. The backrest is connected with the backrest support.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
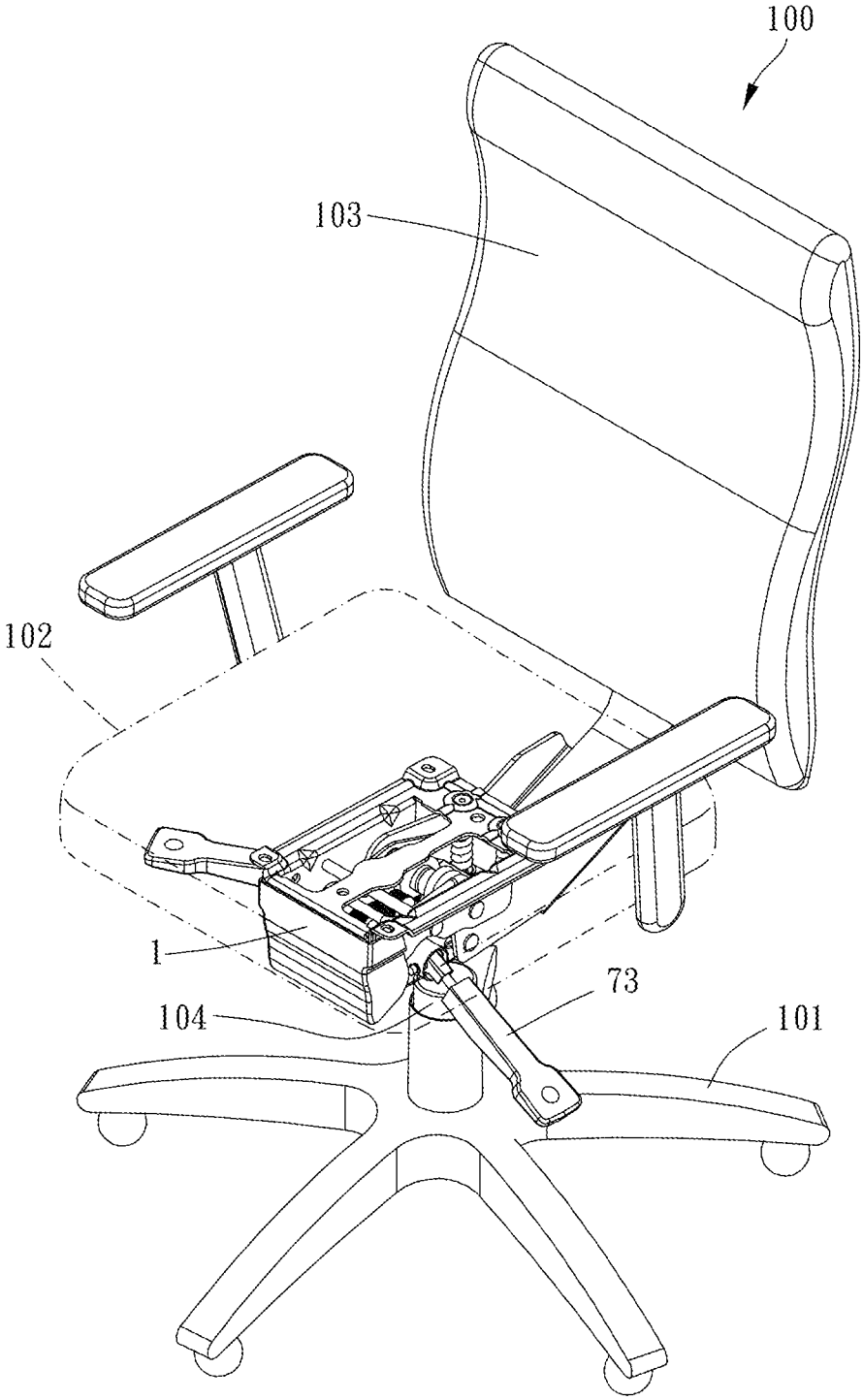
FIG. 1 is a stereogram of a swivel chair of a preferable embodiment of the present invention.
Figure 2:
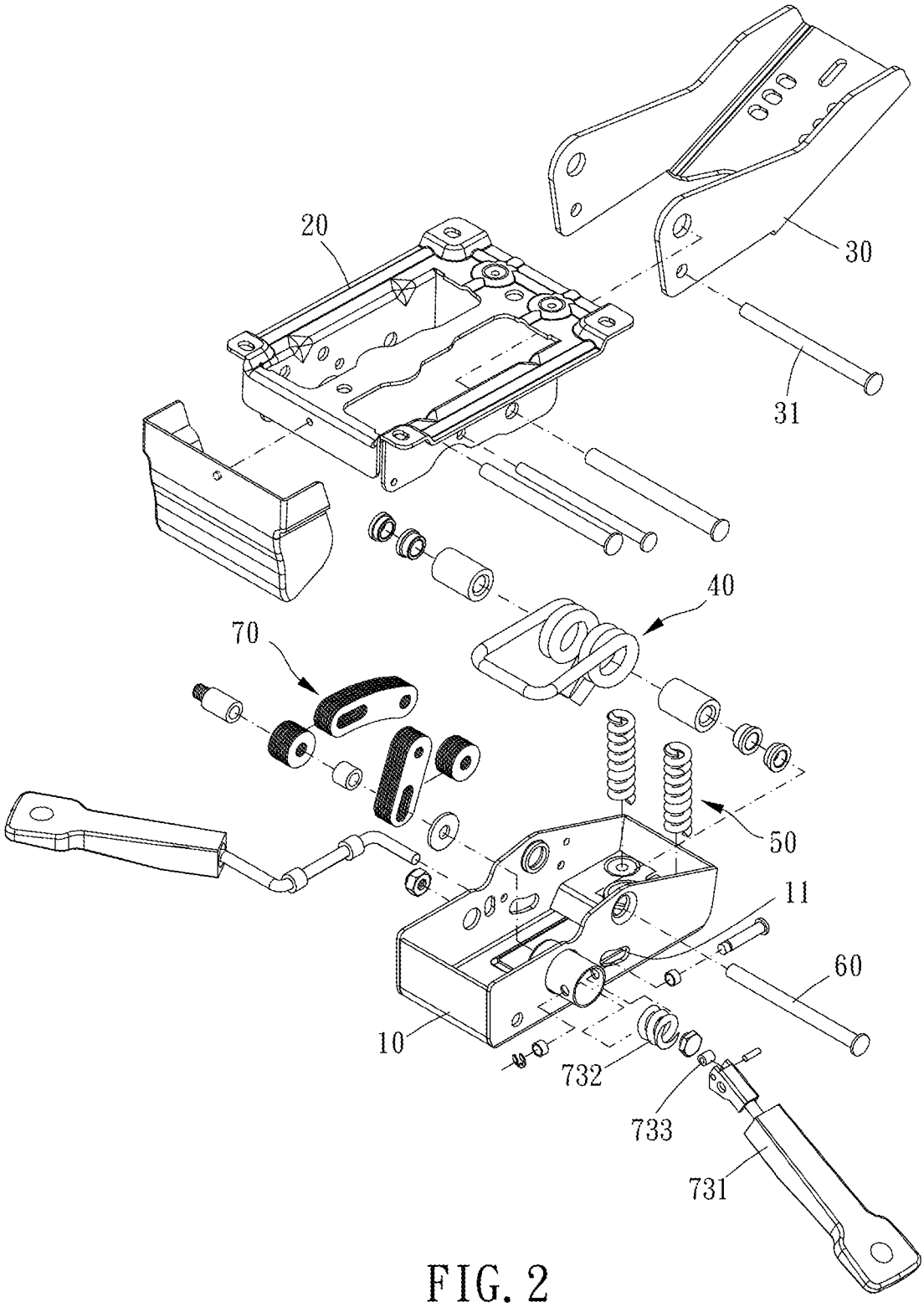
FIG. 2 is a breakdown drawing of a tilting mechanism of a preferable embodiment of the present invention.
Figure 3:
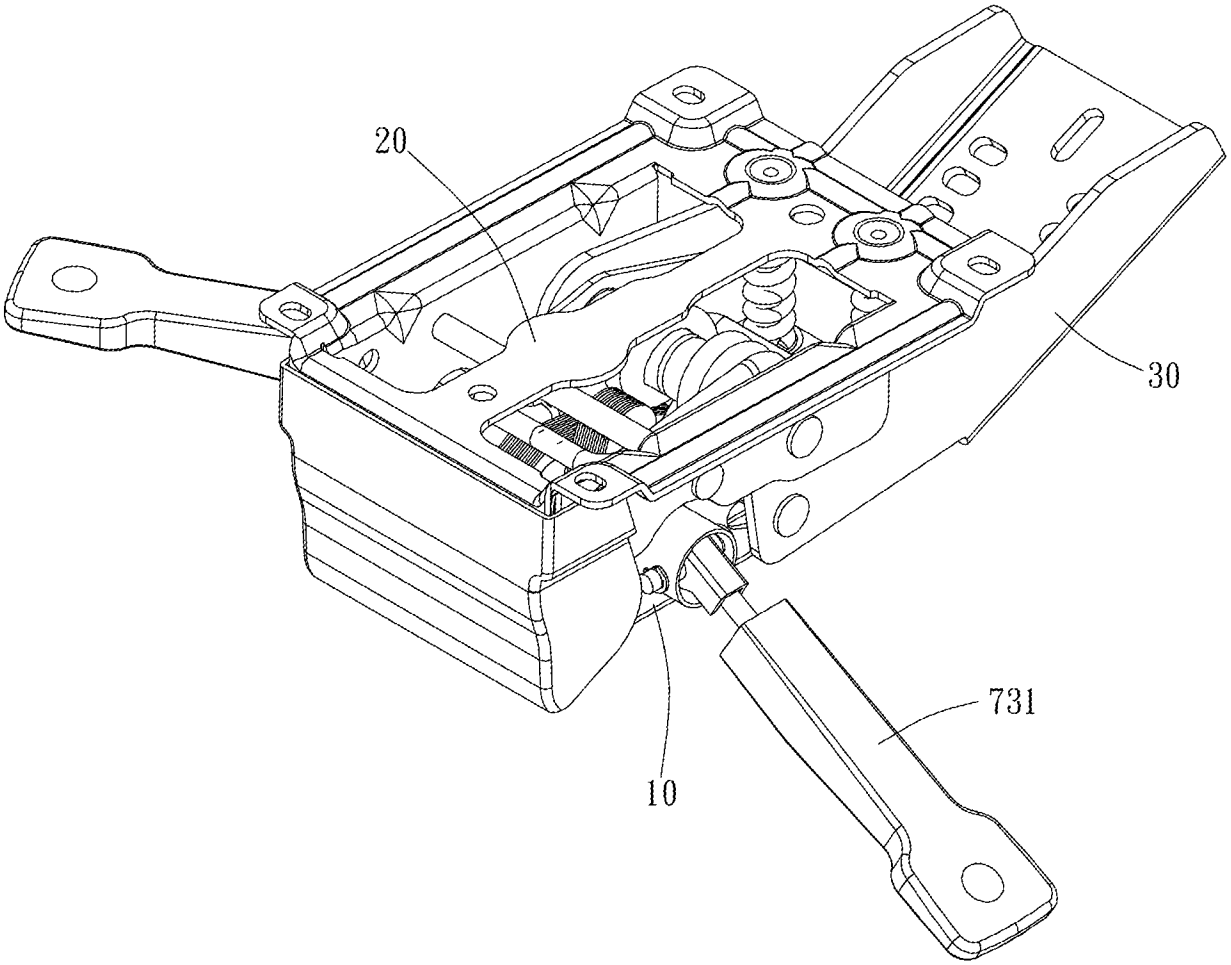
FIG. 3 is a stereogram of a tilting mechanism of a preferable embodiment of the present invention.
Figure 4:
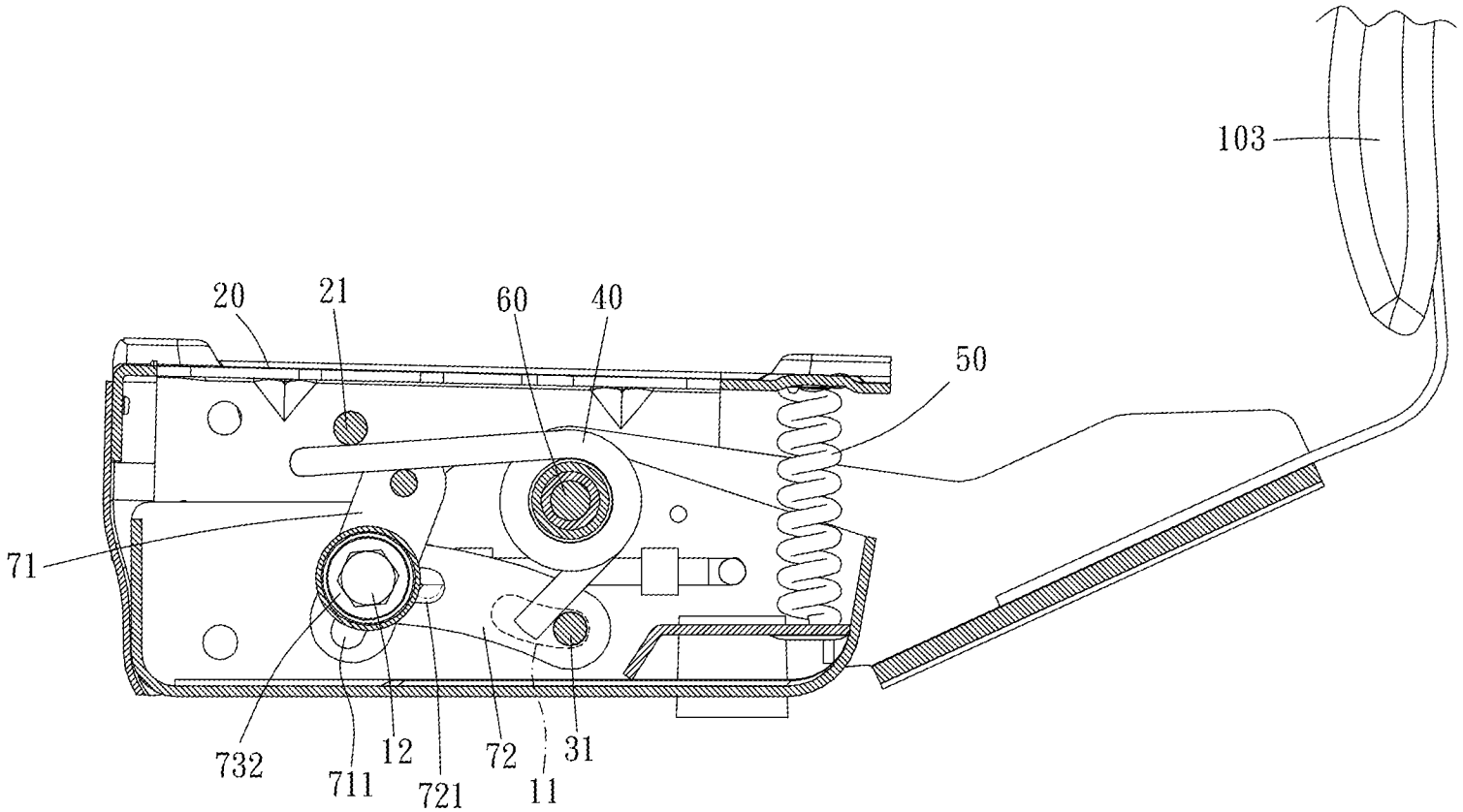
FIG. 4 is a cross-sectional view of a tilting mechanism of a preferable embodiment of the present invention.
Figure 5:
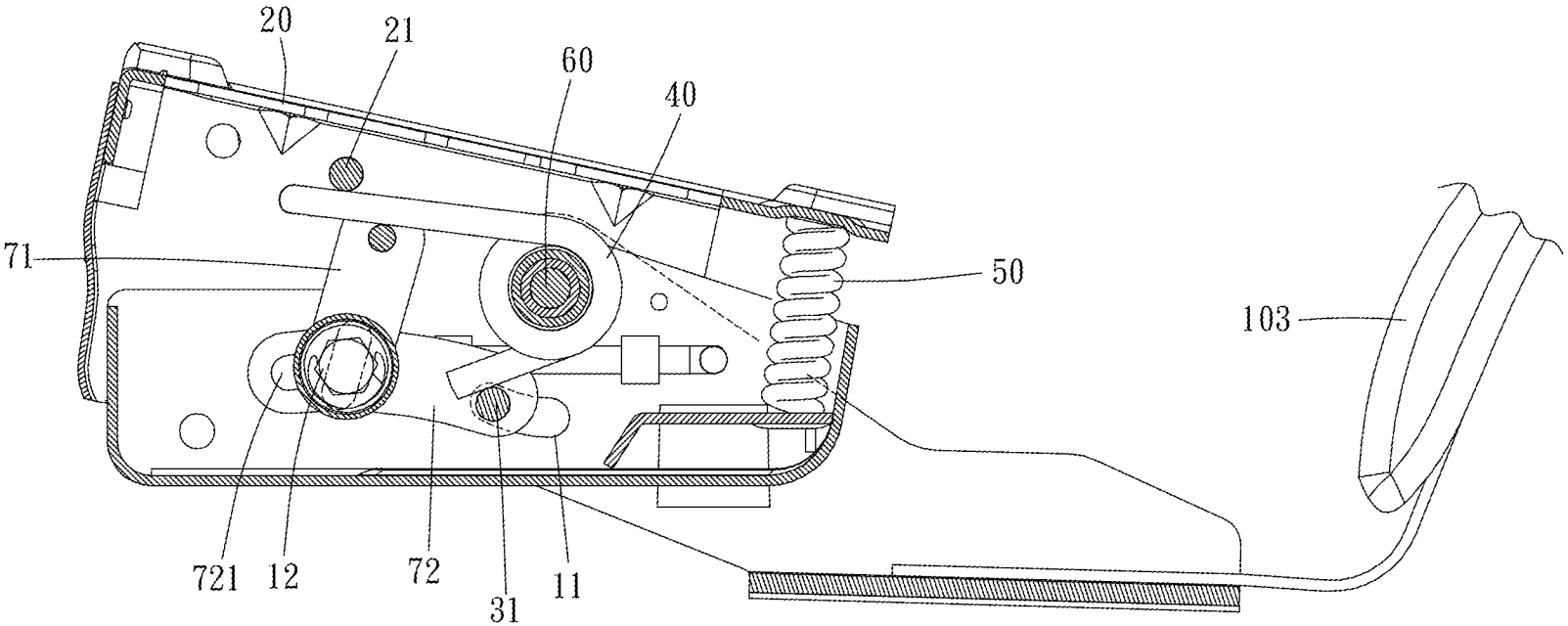
FIG. 5 is a schematic diagram of a tilting mechanism of a preferable embodiment of the present invention in operation.
Figure 6:
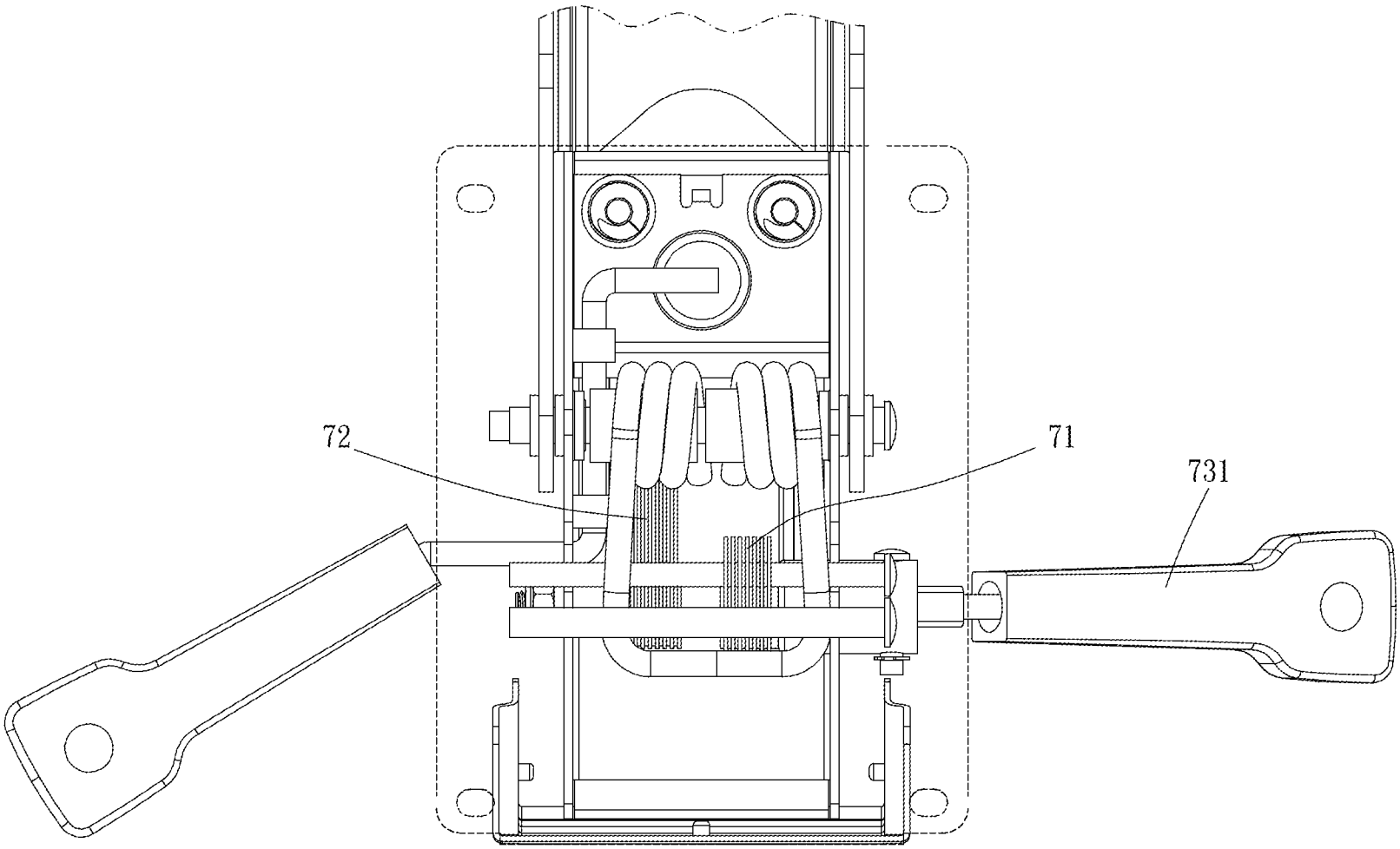
FIG. 6 is a top view of a tilting mechanism of a preferable embodiment of the present invention.
Figure 7:
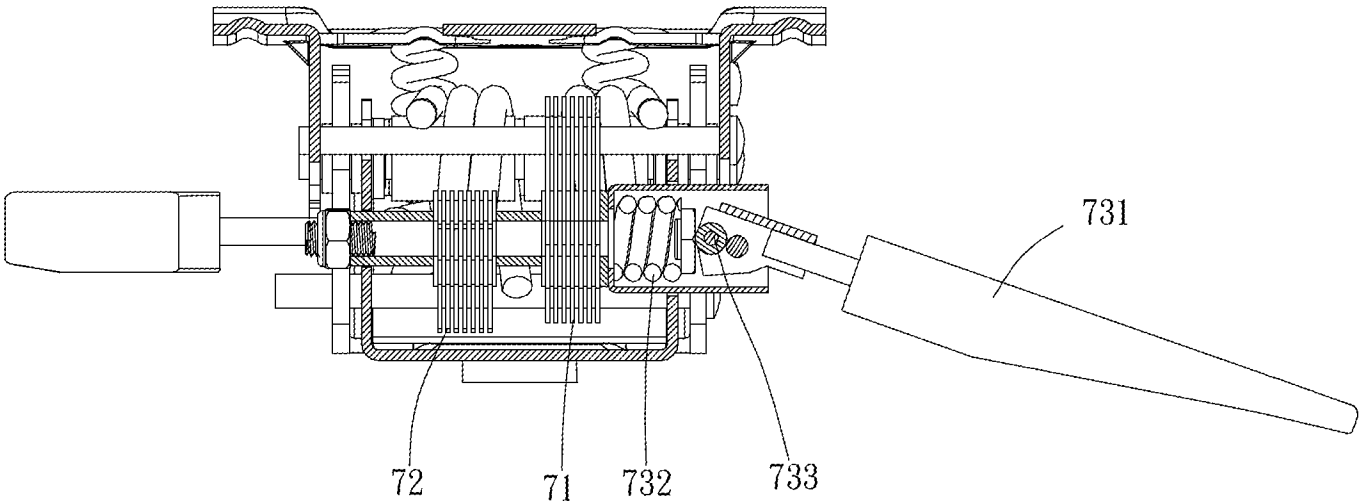
FIGS. 7 and 8 are schematic diagrams showing locking of a tilting mechanism of a preferable embodiment of the present invention.
Figure 8:
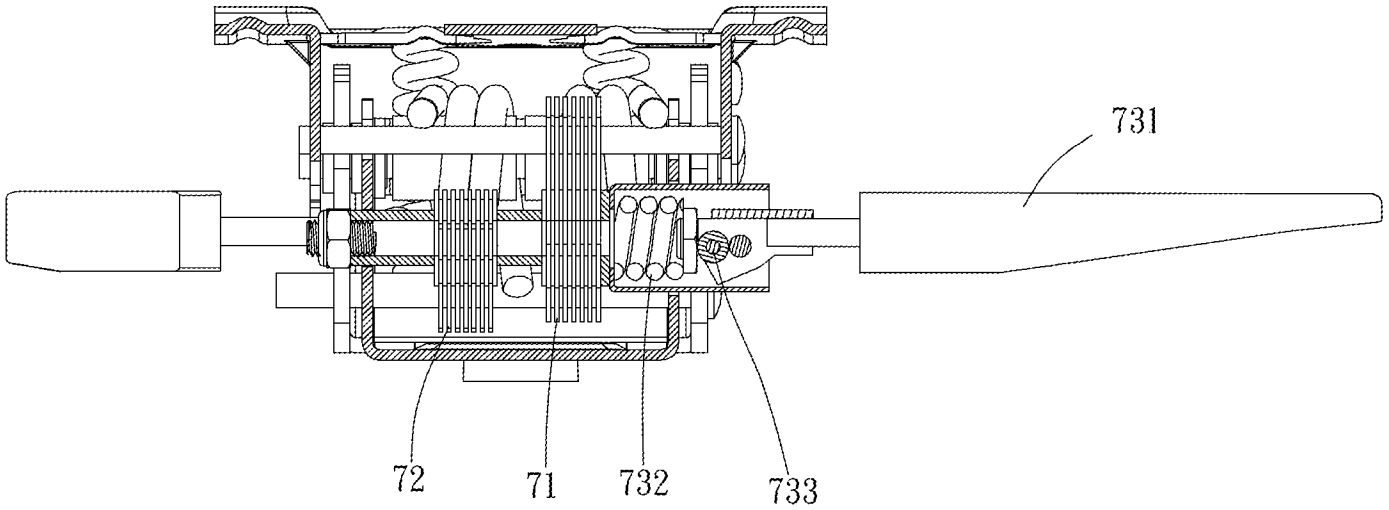

Please refer to FIGS. 1 to 8 for a preferable embodiment of the present invention. An elastic seesaw-type tilting mechanism 1 includes a base support 10, a seat support 20, a backrest support 30, a first elastic mechanism 40 and a second elastic mechanism 50.

The base support 10 is configured to be connected with a chair base 101 through a chair column 104; the seat support 20 is pivotably mounted on the base support 10 and configured to be connected with a seat 102; the backrest support 30 is pivotably mounted on the base support 10 and configured to be connected with a backrest 103; the first elastic mechanism 40 is connected with the seat support 20 and the backrest support 30 to form an elastic seesaw mechanism; the second elastic mechanism 50 is connected with the base support 10 and the seat support 20, the second elastic mechanism 50 and the first elastic mechanism 40 are respectively biased against the seat support 20 in opposite directions. Therefore, the seat 102 and the backrest 103 are independently free adjustable within a sufficient range.

The base support 10, the seat support 20 and the backrest support 30 are pivotably mounted on a shaft 60, and the shaft 60 servers as a fulcrum and a pivot axis of the first elastic mechanism 40 and the elastic seesaw mechanism. The first elastic mechanism 40 is a torsion spring and pivotably connected with the shaft 60. In this embodiment, the first elastic mechanism 40 is pivotably disposed around the shaft 60. However, the first elastic mechanism may be a flat spring, torsion bar, compression spring, extension spring or other elastic or resilient members capable of providing elastic potential energy; the first elastic mechanism may include two elastic components (such as elastic or resilient members described above) or be configured with any of the elastic or resilient members described above to exert force on the seat support and the backrest support.

One of the base support 10 and the backrest support 30 includes at least one guiding groove, and the other of the base support 10 and the backrest support 30 includes at least one guiding member movably disposed within the at least one guiding groove. In this embodiment, the base support 10 includes at least one guiding groove 11, the backrest support 30 includes at least one guiding member 31 movably disposed within the at least one guiding groove 11. Preferably, the at least one guiding groove 11 is an arcuate groove so that the backrest support 30 is stably and smoothly swingable along the at least one guiding groove 11.

The second elastic mechanism 50 includes at least one compression spring or extension spring which is abutted against or connected between the base support 10 and the seat support 20. In this embodiment, the second elastic mechanism 50 is a compression spring, the seat support 20 further includes a seat support adjusting shaft 21, two ends of the torsion spring respectively bias the guiding member 31 and the seat support adjusting shaft 21 in opposite directions, the compression spring and the torsion spring respectively exert force on the seat support 20 at opposite sides of the shaft 60 so that the seat support 20 is under a torque balance state. Preferably, the base support 10 and the seat support 20 may, respectively, include a receiving groove, a column or the like configured for the compression spring to be stably disposed thereon. The second elastic mechanism may be configured to include a compression spring and an extension spring, or a flat spring, torsion bar or other elastic or resilient members capable of providing elastic potential energy. The second elastic mechanism is configured to provide an elastic force which is upward exerted on the seat support, and a direction of the elastic force is opposite to a force that the first elastic mechanism exerted on the seat support so as to provide balance effect. Therefore, the seat and the backrest can automatically and steplessly balance with each other so as to be suitable for various users' requirements.

In this embodiment, the elastic seesaw-type tilting mechanism 1 further includes an associated lock mechanism 70, and the base support 10 includes a lock axle 12. The associated lock mechanism 70 includes a seat support locking member 71 which is connected with the seat support 20 and adjustably connected with the lock axle 12, a backrest support locking member 72 which is connected with the backrest support 30 and adjustably connected with the lock axle 12, and a locking device 73 which is operatable to lock or unlock the lock axle 12, the seat support locking member 71 and the backrest support locking member 72. The lock axle 12 is disposed through a guiding groove 711 of the seat support locking member 71 and a guiding groove 721 of the backrest support locking member 72, the guiding groove 711 of the seat support locking member 71 and the guiding groove 721 of the backrest support locking member 72 allow movement of the seat support locking member 71 and the backrest support locking member 72 relative to the lock axle 12. Preferably, the guiding grooves 711, 721 are arcuate grooves so that the seat support 20 and the backrest support 30 are stably and smoothly swingable along the guiding grooves 711, 721 respectively. The locking device 73 includes a lever 731 disposed on the base support 10 and a compression spring 732 sleeved on the lock axle 12. An end of the lever 731 includes a rolling portion 733 (such as a roller) which is movable by pulling the lever 731 so as to lock or unlock the seat support locking member 71 and the backrest support locking member 72. The compression spring may be any other components and materials configured to lock or unlock the seat support locking member and the backrest support locking member; the locking device may include a plurality of positioning holes which are disposed on the seat support or/and the backrest support and at least one pin disposed on the base support, the at least one pin may be restrictedly moved, by a lever or cable for example, and inserted within one of the plurality of positioning holes after adjustment so as to maintain a configuration of the elastic seesaw-type tilting mechanism.

Figure 9:
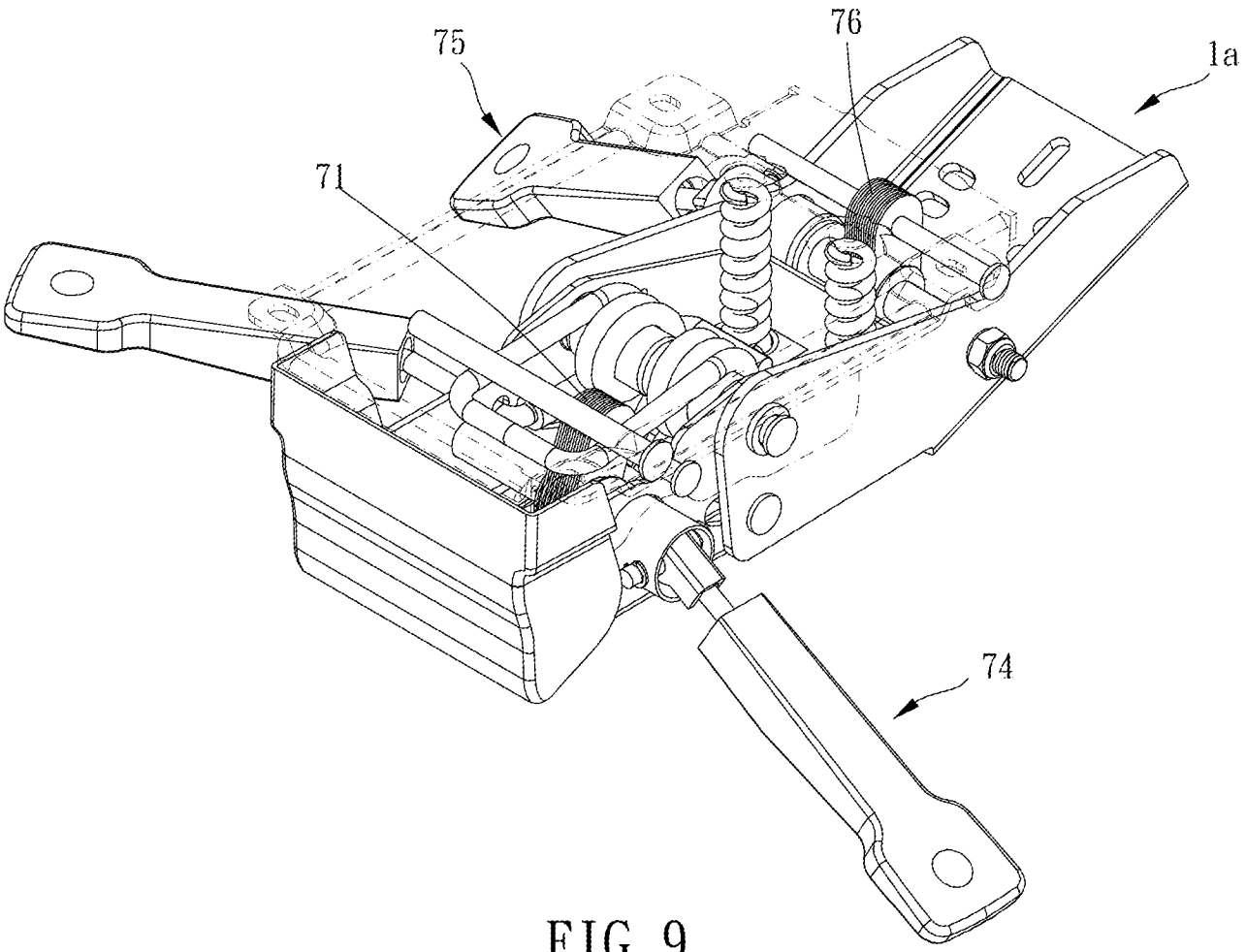
FIG. 9 is a stereogram of a tilting mechanism of another preferable embodiment of the present invention.
Figure 10:
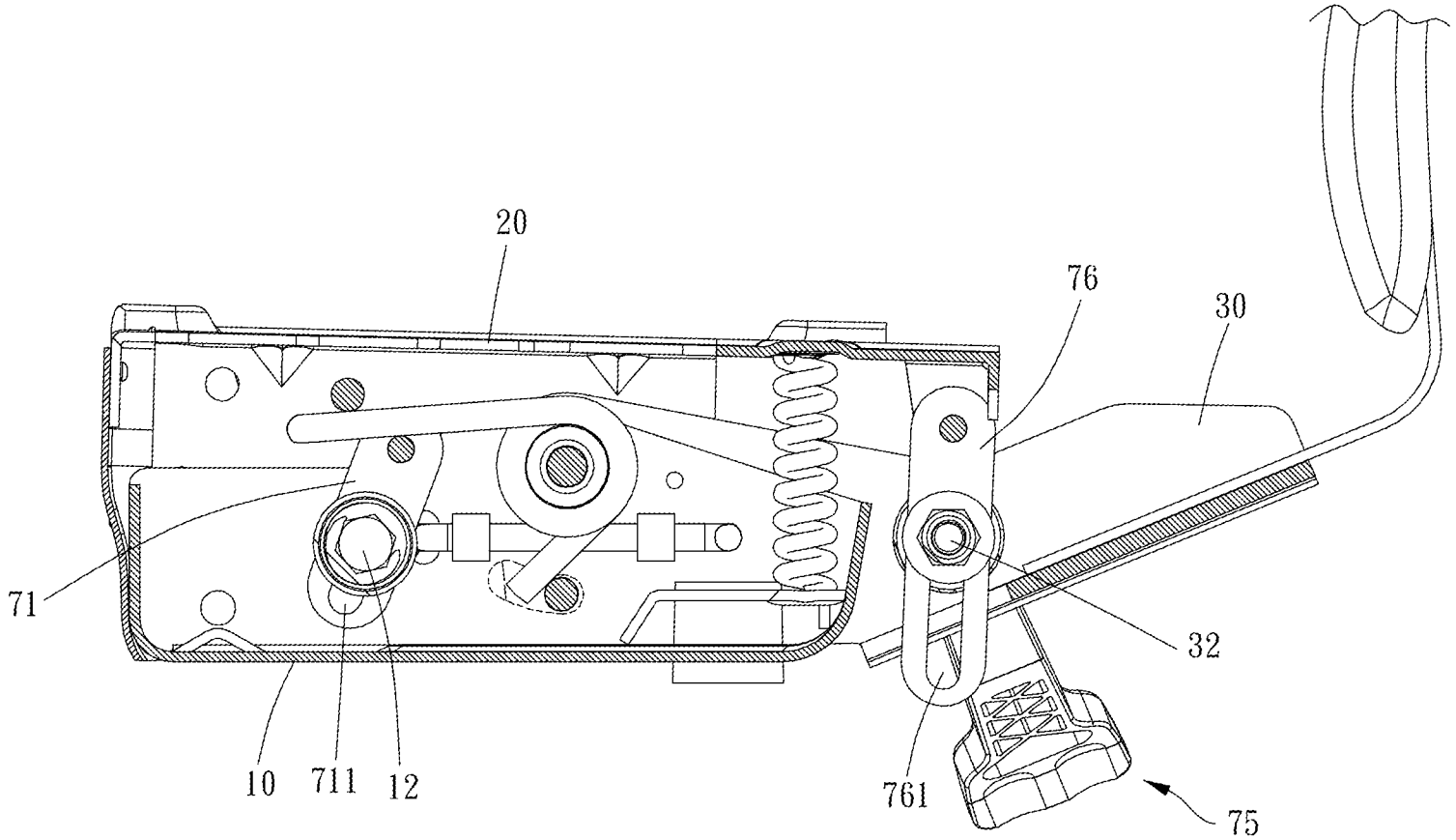
FIGS. 10 and 11 are schematic diagrams showing locking of a tilting mechanism of another preferable embodiment of the present invention.
Figure 11:
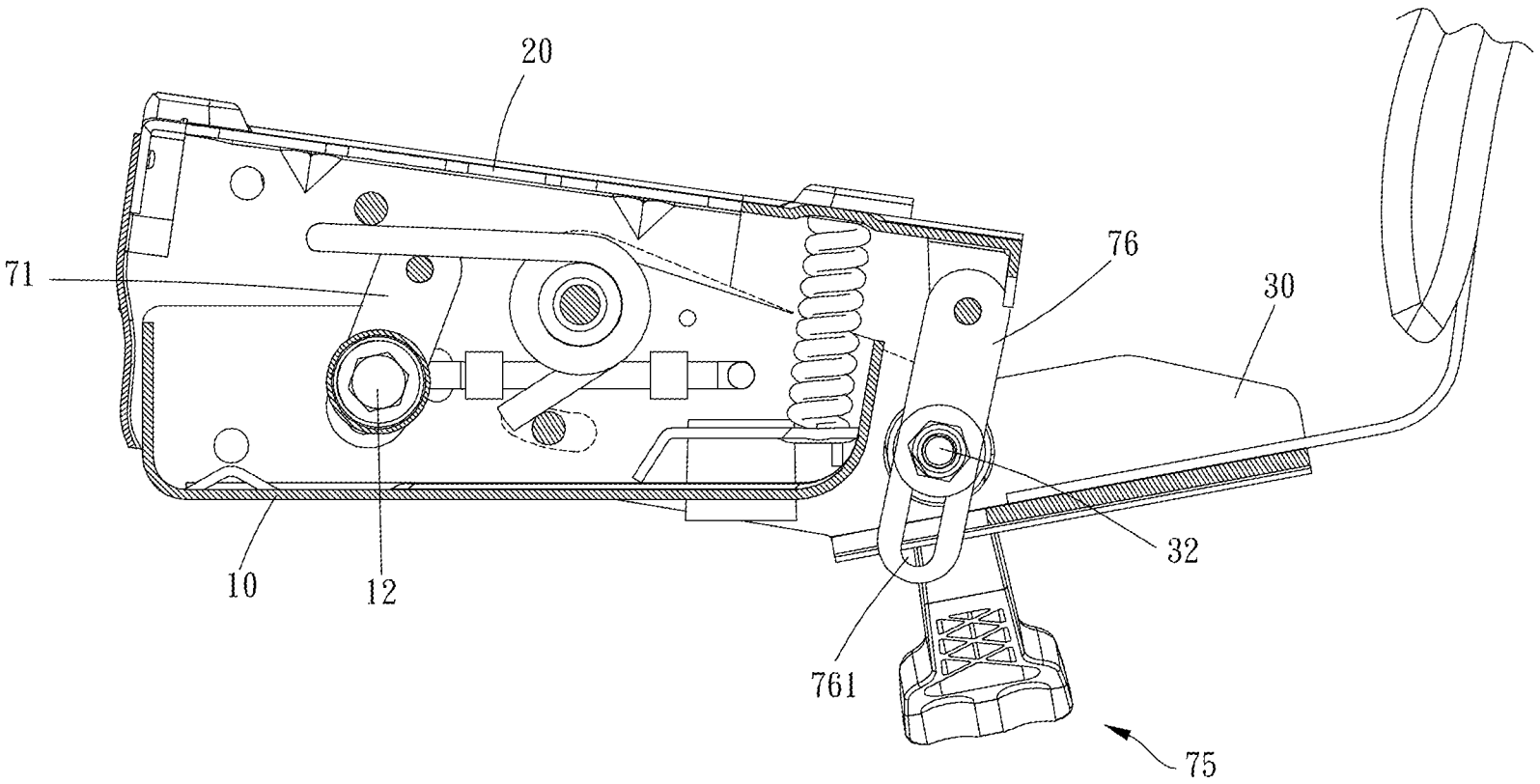

FIGS. 9 to 11 show another preferable embodiment of the present invention. The elastic seesaw-type tilting mechanism 1*a* further includes a seat support locking device 74, a backrest support locking device 75, a seat support locking member 71 and a backrest support locking member 76. The base support 10 includes a lock axle 12, the backrest support 30 includes a lock axle 32, and the seat support locking member 71 is connected with the seat support 20 and adjustably connected with the lock axle 12 of the base support 10. The backrest support locking member 76 is connected with the seat support 20 and adjustably connected with the lock axle 32 of the backrest support 30. The seat support locking device 74 is operatable to lock or unlock the seat support locking member 71 and the lock axle 12 of the base support 10, and the backrest support locking device 75 is operatable to lock or unlock the backrest support locking member 76 and the lock axle 32 of the backrest support 30. The lock axle 12 of the base support 10 is disposed through a guiding groove 711 of the seat support locking member 71, and the guiding groove of the seat support locking member 71 allows movement of the seat support locking member 71 relative to the lock axle 12 of the base support 10. The lock axle 32 of the backrest support 30 is disposed through a guiding groove 761 of the backrest support locking member 76, and the guiding groove 761 of the backrest support locking member 76 allows movement of the backrest support locking member 76 relative to the lock axle 32 of the backrest support 30. Therefore, the seat support 20 and the backrest support 30 are adjustable and positioned independently.

The present invention further provides a swivel chair 100 which includes one of the elastic seesaw-type tilting mechanism described above, further including a seat 102, a backrest 103, a chair column 104 and a chair base 101. Preferably, the chair column 104 is a gas spring, and the gas spring is connected between the base support 10 and the chair base 101 and the base support 10 is liftable relative to the chair base 101.

In summary, the elastic seesaw-type tilting mechanism allows the seat and the backrest to be adjustable and lockable independently or simultaneously so as to meet individual requirements. The swivel chair with the elastic seesaw-type tilting mechanism can sufficiently satisfy the user's requirements for reclining comfortability and increase delight in using experience.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An elastic seesaw-type tilting mechanism, including:

a base support, configured to be connected with a chair base through a chair column;

a seat support, being pivotably mounted on the base support and configured to be connected with a seat;

a backrest support, being pivotably mounted on the base support and configured to be connected with a backrest;

a first elastic mechanism, being connected with the seat support and the backrest support to form an elastic seesaw mechanism; and a second elastic mechanism, being connected with the base support and the seat support, the second elastic mechanism and the first elastic mechanism being respectively biased against the seat support in opposite directions;

wherein the base support, the seat support and the backrest support are pivotably mounted on a shaft, the first elastic mechanism is pivotably disposed around the shaft, and the shaft serves as a fulcrum and a pivot axis of the first elastic mechanism and the elastic seesaw mechanism.

2. The elastic seesaw-type tilting mechanism of claim 1, wherein the second elastic mechanism is disposed between the base support and the seat support.

3. The elastic seesaw-type tilting mechanism of claim 1, wherein one of the base support and the backrest support includes at least one guiding groove, and the other of the base support and the backrest support includes at least one guiding member movably disposed within the at least one guiding groove.

4. The elastic seesaw-type tilting mechanism of claim 1, further including an associated lock mechanism, wherein the base support includes a lock axle, the associated lock mechanism includes a seat support locking member which is connected with the seat support and adjustably connected with the lock axle, a backrest support locking member which is connected with the backrest support and adjustably connected with the lock axle, and a locking device which is operatable to lock or unlock the lock axle, the seat support locking member and the backrest support locking member.

5. The elastic seesaw-type tilting mechanism of claim 4, wherein the lock axle is disposed through a guiding groove of the seat support locking member and a guiding groove of the backrest support locking member, the guiding groove of the seat support locking member and the guiding groove of the backrest support locking member allow movement of the seat support locking member and the backrest support locking member relative to the lock axle.

6. The elastic seesaw-type tilting mechanism of claim 5, wherein the second elastic mechanism is disposed between the base support and the seat support; the base support includes at least one guiding groove, the backrest support includes at least one guiding member movably disposed within the at least one guiding groove; the seat support further includes a seat support adjusting shaft, two ends of the first elastic mechanism respectively bias the guiding member and the seat support adjusting shaft in opposite directions; the first elastic mechanism and the second elastic mechanism respectively exert force, in opposite directions, on the seat support so that the seat support is under a torque balance state.

7. The elastic seesaw-type tilting mechanism of claim 1, further including a seat support locking device, a backrest support locking device, a seat support locking member and a backrest support locking member, wherein the base support includes a lock axle, the backrest support includes a lock axle, the seat support locking member is connected with the seat support and adjustably connected with the lock axle of the base support, the backrest support locking member is connected with the seat support and adjustably connected with the lock axle of the backrest support, the seat support locking device is operatable to lock or unlock the seat support locking member and the lock axle of the base support, and the backrest support locking device is operatable to lock or unlock the backrest support locking member and the lock axle of the backrest support.

8. The elastic seesaw-type tilting mechanism of claim 7, wherein the lock axle of the base support is disposed through a guiding groove of the seat support locking member, the guiding groove of the seat support locking member allows movement of the seat support locking member relative to the lock axle of the base support; the lock axle of the backrest support is disposed through the a guiding groove of the backrest support locking member, the guiding groove of the backrest support locking member allows movement of the backrest support locking member relative to the lock axle the backrest support.

9. A swivel chair, including one of the elastic seesaw-type tilting mechanism of claim 1, further including a seat, a backrest, a chair column and a chair base, the backrest connected with the backrest support.

10. The swivel chair of claim 9, wherein the chair column is a gas spring, and the base support is liftable relative to the chair base.

* * * * *